US010274867B2

(12) United States Patent
Hayashi

(10) Patent No.: US 10,274,867 B2
(45) Date of Patent: Apr. 30, 2019

(54) IMAGE FORMING APPARATUS INCLUDING A DEVELOPING DEVICE HAVING FIRST CONVEYANCE CHAMBER AND A SECOND CONVEYANCE CHAMBER DISPOSED ABOVE THE FIRST CONVEYANCE CHAMBER

(71) Applicant: KYOCERA Document Solutions Inc., Osaka (JP)

(72) Inventor: Masaki Hayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 46 days.

(21) Appl. No.: 15/926,804

(22) Filed: Mar. 20, 2018

(65) Prior Publication Data

US 2018/0321614 A1 Nov. 8, 2018

(30) Foreign Application Priority Data

May 8, 2017 (JP) ..... 2017-092351

(51) Int. Cl.
*G03G 15/08* (2006.01)

(52) U.S. Cl.
CPC ..... *G03G 15/0877* (2013.01); *G03G 15/0865* (2013.01); *G03G 15/0891* (2013.01); *G03G 15/0893* (2013.01)

(58) Field of Classification Search
CPC ..... G03G 15/0877; G03G 15/0891; G03G 15/0865; G03G 15/0893
See application file for complete search history.

(56) References Cited

U.S. PATENT DOCUMENTS

2005/0031381 A1* 2/2005 Arimoto ..... G03G 15/0877 399/258
2006/0029432 A1 2/2006 Arimoto et al. ..... 399/254
2014/0301747 A1 10/2014 Takahashi et al. ..... 399/30
2015/0010315 A1* 1/2015 Nakayama ..... G03G 15/0849 399/30

FOREIGN PATENT DOCUMENTS

JP 2006-47884 A 2/2006
JP 2013-238836 A 11/2013
JP 2016110023 A * 6/2016

* cited by examiner

*Primary Examiner* — Joseph S Wong
(74) *Attorney, Agent, or Firm* — Stein IP, LLC

(57) ABSTRACT

An image forming apparatus includes a developing device, a toner reservoir, a toner replenishing device, a development driving device, a developer amount detecting sensor, and a controller. The developing device includes a developing container, a first stirring-conveyance member, a second stirring-conveyance member, and a developer carrier. The developing container includes a first conveyance chamber and a second conveyance chamber disposed above the first conveyance chamber. The developer amount detecting sensor detects an amount of developer that falls from the second conveyance chamber to the vicinity of a toner replenishing port in the first conveyance chamber. The controller controls the driving of the toner replenishing device or the driving of the development driving device based on a result of detection performed by the developer amount detecting sensor, and thereby keeps a replenished-toner concentration in the developer substantially constant in the vicinity of the toner replenishing port.

4 Claims, 4 Drawing Sheets

IMAGE FORMING APPARATUS INCLUDING A DEVELOPING DEVICE HAVING FIRST CONVEYANCE CHAMBER AND A SECOND CONVEYANCE CHAMBER DISPOSED ABOVE THE FIRST CONVEYANCE CHAMBER

INCORPORATION BY REFERENCE

This application is based upon and claims the benefit of priority from the corresponding Japanese Patent Application No. 2017-92351 filed on May 8, 2017, the entire contents of which are incorporated herein by reference.

BACKGROUND

The present disclosure relates to image forming apparatuses such as copiers, printers, facsimile machines, and so on, and in particular, relates to image forming apparatuses including a developing device having a first conveyance chamber and a second conveyance chamber disposed above the first conveyance chamber.

In an image forming apparatus, an electrostatic latent image formed on an image carrier, such as a photosensitive member, is developed by a developing device and visualized as a toner image. A known example of such a developing device is one that includes a developing container which holds therein a developer, first and second stirring-conveyance members which convey the developer, while stirring the developer, and a developing roller (a developer carrier) which carries thereon the developer supplied thereto from the second stirring-conveyance member. The first stirring-conveyance member conveys the developer to one side in the axial direction of the developing roller, and the second stirring-conveyance member supplies the developer to the developing roller while conveying the developer to the other side (the side opposite from the one side).

In recent years, there has been an increasing demand for miniaturization of image forming apparatuses, and in particular, in color image forming apparatuses, in which a plurality of developing devices are disposed, there has been a demand for miniaturization of developing devices. As an example of developing devices meeting such a demand, there is known one that includes a first conveyance chamber inside which a first stirring-conveyance member is disposed and a second conveyance chamber which is disposed above the first conveyance chamber and inside which a second stirring-conveyance member is disposed. By arranging the first conveyance chamber and the second conveyance chamber one above the other in this developing device, it is possible to make it compact in the horizontal direction. Accordingly, it is possible to reduce space for installing the developing device, and thus, it is possible to achieve the miniaturization of image forming apparatuses.

However, in the above-described developing device, there is an area where the developer is conveyed against gravity, from the first conveyance chamber to the second conveyance chamber. With this structure, when change in flowability of the developer results from factors such as durable printing and environmental variation, the circulation balance of the developer is likely to change, and thus uneven distribution of the developer is likely to occur inside the developing device. When, in such a condition, toner is replenished to a portion where only a small amount of developer exists, it will create a portion where the concentration of the replenished toner is locally high. The replenished toner is not sufficiently mixed with a carrier in the developer and thus is low in charge amount, and accordingly, when the portion with a high replenished-toner concentration is used for development, it will result in problems such as fogged images and uneven image density.

To prevent such problems, there have been proposed various methods for fully mixing developer inside a developing device with replenished toner. For example, there has been known a developing device which has a communication path through which the developer is delivered from a developing chamber to a stirring chamber by conveying the developer to fall from a downstream side of the developing chamber to an upstream side of the stirring chamber in the developer conveyance direction, and in which replenished developer replenished through a developer replenishing port above the stirring chamber falls onto an area in the stirring chamber where the communication path joins the stirring chamber.

Furthermore, there has been known a developing device where, for the purpose of maintaining the circulation balance, after executing a low speed mode in which a developer carrier and a conveyance member are driven at a speed lower than usual, an idle driving mode is executed in which the conveyance member is idly driven at a high driving speed for a predetermined time.

SUMMARY

According to one aspect of the present disclosure, an image forming apparatus includes a developing device, a toner reservoir, a toner replenishing device, a development driving device, a developer amount detecting sensor, and a controller. The developing device includes a developing container, a first stirring-conveyance member, a second stirring-conveyance member, and a developer carrier. The developing container includes a first conveyance chamber, a second conveyance chamber disposed above the first conveyance chamber, a first communication portion which allows the first conveyance chamber and the second conveyance chamber to communicate with each other at end portions thereof on a downstream side in a first direction, a second communication portion which allows the first conveyance chamber and the second conveyance chamber to communicate with each other at end portions thereof on a downstream side in a second direction, and a toner replenishing port which is disposed at an end portion of the first conveyance chamber on the downstream side in the second direction for toner replenishment to the developing container. The developing container holds therein a two-component developer including a carrier and a toner. The first stirring-conveyance member is rotatably supported inside the first conveyance chamber, and conveys the developer inside the first conveyance chamber in the first direction, while stirring the developer. The second stirring-conveyance member is rotatably supported inside the second conveyance chamber, and conveys the developer inside the second conveyance chamber in the second direction, which is a direction opposite to the first direction, while stirring the developer. The developer carrier is rotatably supported in the developing container, and carries on a surface thereof the developer in the second conveyance chamber. The toner reservoir holds therein the toner to be replenished to the developing device. The toner replenishing device replenishes the toner from the toner reservoir to the developing device. The development driving device drives the first stirring-conveyance member and the second stirring-conveyance member. The controller controls driving of the toner replenishing device and driving of the development driving device. The developer amount detecting sensor detects an amount of developer conveyed from the second conveyance chamber, through the second communication portion, to fall to the vicinity of the toner replenishing port in the first conveyance chamber. The controller controls driving of the toner replenishing device or driving of the development driving device based on a result of detection performed by the developer amount detecting sensor, and thereby keeps a replenished-toner concentration in the developer substantially constant in the vicinity of the toner replenishing port.

Further features and advantages of the present disclosure will become apparent from the description of embodiments given below.

DETAILED DESCRIPTION

Figure 1:
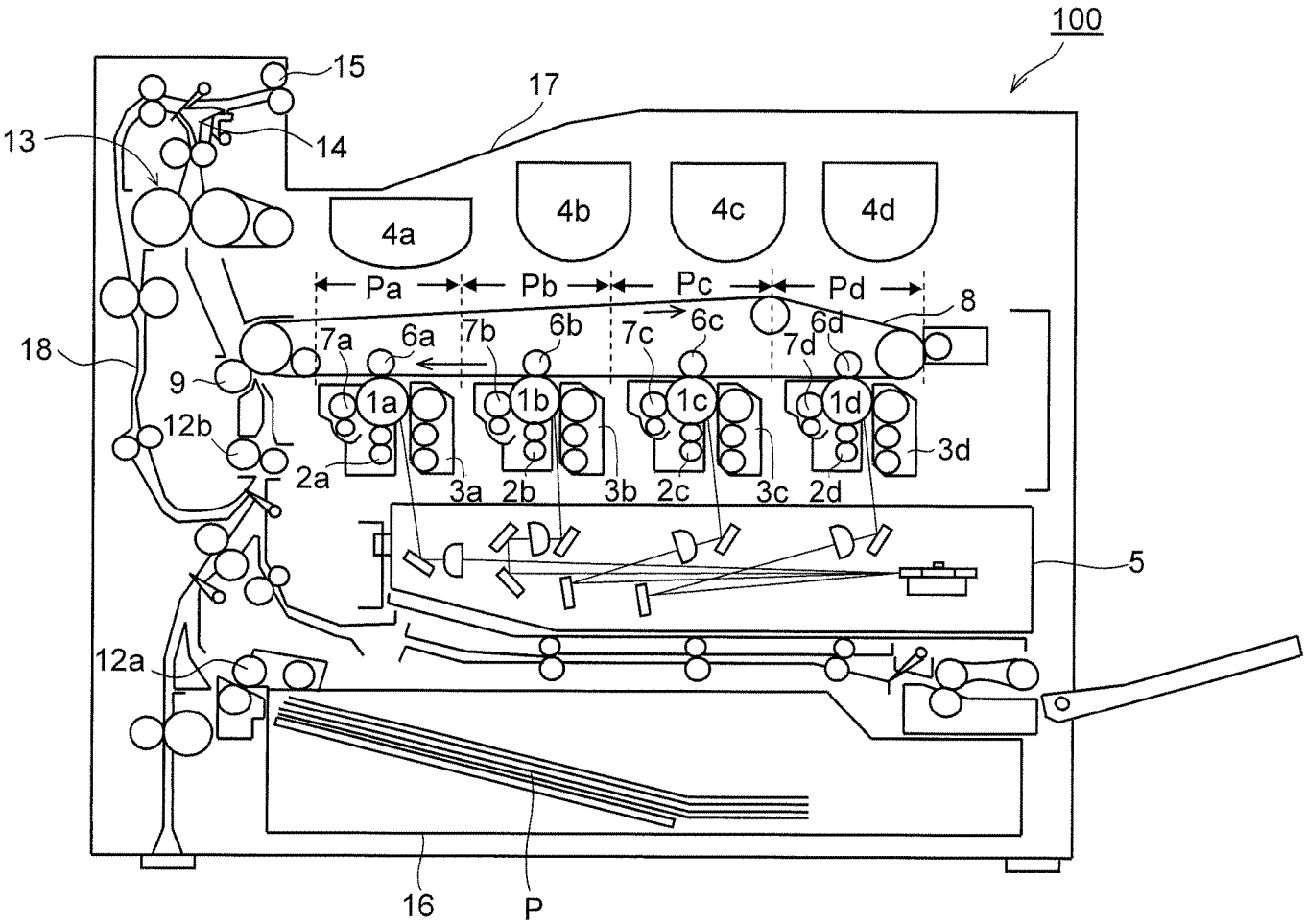
FIG. 1 is a schematic sectional view illustrating an overall configuration of a color printer of the present disclosure.

Hereinafter, embodiments of the present disclosure will be described with reference to the accompanying drawings. FIG. 1 is a schematic sectional view of a color printer 100 embodying the present disclosure, and the color printer 100 illustrated here is a tandem-type color printer. Inside a main body of the color printer 100, four image formers Pa, Pb, Pc, and Pd are arrange in this order from a downstream side in a transport direction (the right side in FIG. 1). The image formers Pa to Pd are provided corresponding to images of four different colors (cyan, magenta, yellow, and black), and sequentially form images of cyan, magenta, yellow, and black through charging, exposure, developing, and transfer processes.

The image formers Pa to Pd are each provided with a corresponding one of photosensitive drums 1*a*, 1*b*, 1*c*, and 1*d*, which each carry a visible image (a toner image) of a corresponding color, and further, an intermediate transfer belt 8, which rotates in a clockwise direction in FIG. 1, is provided adjacent to the image formers Pa to Pd.

When image data is fed from a host device such as a personal computer, first, charging devices 2*a* to 2*d* uniformly charge surfaces of the photosensitive drums 1*a* to 1*d*. Then, an exposure device 5 irradiates the photosensitive drums 1*a* to 1*d* with light in accordance with the image data to form an electrostatic latent image on each of the photosensitive drums 1*a* to 1*d* in accordance with the image data. Developing devices 3*a* to 3*d* are each filled, by toner containers 4*a* to 4*d*, with a predetermined amount of two-component developer (which hereinafter may be referred to simply as developer) including a toner of a corresponding one of the four colors of cyan, magenta, yellow and black, and the toner included in the developer is supplied by a corresponding one of the developing devices 3*a* to 3*d* onto a corresponding one of the photosensitive drums 1*a* to 1*d* to electrostatically adhere thereto. Thereby, a toner image is formed in accordance with the electrostatic latent image, which has been formed by the exposure to the light emitted from the exposure device 5.

Then, by primary transfer rollers 6*a* to 6*d*, an electric field is applied at a predetermined transfer voltage between the primary transfer rollers 6*a* to 6*d* and the photosensitive drums 1*a* to 1*d*, and the toner images of cyan, magenta, yellow, and black on the photosensitive drums 1*a* to 1*d* are primarily transferred onto the intermediate transfer belt 8. After the primary transfer, residual toner and the like left on the surfaces of the photosensitive drums 1*a* to 1*d* are removed by cleaning devices 7*a* to 7*d*.

Transfer sheets P onto one of which the toner images are to be transferred are stacked in a sheet cassette 16 disposed in a lower part inside the color printer 100, and a transfer sheet P is conveyed at a predetermined timing via a sheet feeding roller 12*a* and a registration roller pair 12*b* to a nip portion (secondary transfer nip portion) between the intermediate transfer belt 8 and a secondary transfer roller 9 provided adjacent to the intermediate transfer belt 8. The transfer sheet P, after having the toner images transferred thereon, is conveyed to a fixer 13.

To the transfer sheet P, which has been transported to the fixer 13, heat and pressure is applied by a fixing roller pair 13*a*, and thereby the toner images are fixed to a surface of the transfer sheet P, and thereby a predetermined full-color image is formed. The transfer sheet P, on which the full-color image has been formed, is discharged onto a discharge tray 17 by a discharge roller pair 15 as it is (or after being directed by a branching unit 14 into a reverse transport path 18 and having an image formed on the other side, too).

Figure 2:
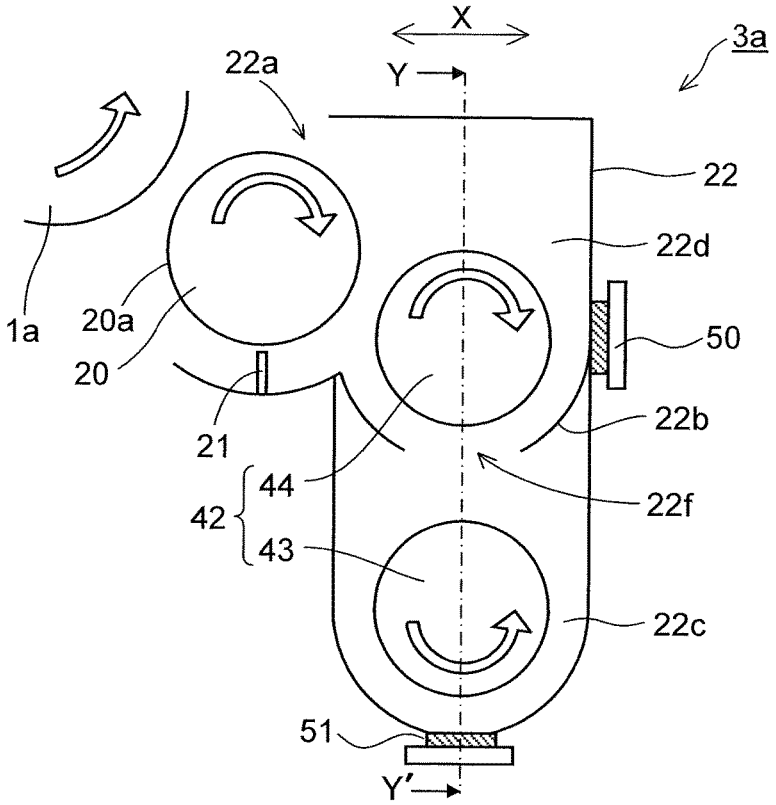
FIG. 2 is a side sectional view illustrating a structure of a developing device incorporated in a color printer of a first embodiment of the present disclosure.

FIG. 2 is a side sectional view illustrating a structure of the developing device 3*a* incorporated in the color printer 100 of the first embodiment of the present disclosure. Here, in the following description, only the developing device 3*a* disposed in the image former Pa in FIG. 1 will be dealt with as a representative example, and the developing devices 3*b* to 3*d* arranged in the image formers Pb to Pd will not be described. This is because the developing devices 3*b* to 3*d* all have basically the same structure as the developing device 3*a*. As illustrated in FIG. 2, the developing device 3*a* includes a developing roller (developer carrier) 20, a stirring-conveyance member 42, and a developing container 22.

The developing container 22 forms a housing of the developing device 3*a*, and is divided, by a partition 22*b*, into a first conveyance chamber 22*c* and a second conveyance chamber 22*d*. The first conveyance chamber 22*c* and the second conveyance chamber 22*d* hold therein a two-component developer including a toner and a carrier. The developing container 22 rotatably holds the stirring-conveyance member 42 and the developing roller 20. Furthermore, in the developing container 22, an opening 22*a* is formed through which the developing roller 20 is exposed toward the photosensitive drum 1*a*.

The stirring-conveyance member 42 is composed of two spirals, namely, a first spiral (a first stirring-conveyance member) 43 and a second spiral (a second stirring-conveyance member) 44. The first spiral 43 is disposed below the second spiral 44, inside the first conveyance chamber 22*c*. The second spiral 44 is disposed in the second conveyance chamber 22*d*, which is disposed above the first conveyance chamber 22*c*.

The first and second spirals 43 and 44 stir the developer to charge the toner in the developer to a predetermined level. This enables the toner to be held on the carrier. Furthermore, at both end portions of the partition 22*b* in its longitudinal direction (a direction perpendicular to the sheet on which FIG. 2 is drawn), the partition 22*b* dividing the first conveyance chamber 22*c* and the second conveyance chamber 22*d* from each other, communication portions (a first communication portion 22*e* and a second communication portion 22*f* which will be described later) are disposed. When the first spiral 43 rotates, the charged developer is conveyed through one of the communication portions, disposed in the partition 22*b*, to the second spiral 44, and thereby the developer circulates inside the first conveyance chamber 22*c* and the second conveyance chamber 22*d*. Then, the developer is supplied from the second spiral 44 to the developing roller 20 to form a magnetic brush on the developing roller 20.

The developing roller 20 includes a fixed shaft (not shown) and a developing sleeve 20*a* formed in a cylindrical shape. The developing sleeve 20*a* is rotatably held on the fixed shaft. Near the developing sleeve 20*a*, a regulation blade 21 is disposed at a predetermined distance from the developing sleeve 20*a*. The regulation blade 21 regulates the layer thickness of the magnetic brush formed on the surface of the developing sleeve 20*a*. The developing sleeve 20*a* is caused to rotate in an arrow direction in FIG. 2 (a clockwise direction) by a driving mechanism including a motor and a gear, of which none is illustrated. Furthermore, to the developing sleeve 20*a*, a developing bias is applied which is obtained by superposing an alternating current voltage on a direct current voltage.

When the developing sleeve 20*a*, to which the developing bias is applied, rotates in the clockwise direction in FIG. 2, a potential difference between the developing bias and the exposed portion of the photosensitive drum 1*a* causes the toner to be supplied from the magnetic brush carried on the surface of the developing sleeve 20*a* to the photosensitive drum 1*a*. The toner sequentially adheres to the exposed portion on the photosensitive drum 1*a* rotating in a counter-clockwise direction, and an electrostatic latent image on the photosensitive drum 1*a* is developed with the toner.

On a side surface of the second conveyance chamber 22*d*, a developer amount detecting sensor 50 is disposed which detects an amount of developer conveyed inside the second conveyance chamber 22*d*. Used here as the developer amount detecting sensor 50 is a piezoelectric sensor which generates an electric signal when pressure is applied to a detection surface. The higher the level (bulk) of the developer conveyed inside the second conveyance chamber 22*d* becomes, the larger the pressure applied to the detection surface of the developer amount detecting sensor 50 becomes, and thus, an amount of developer is detectable based on a detection signal transmitted from the developer amount detecting sensor 50.

As illustrated in later-described FIG. 3, the developer amount detecting sensor 50 is disposed in the second conveyance chamber 22*d*, at a position immediately adjacent to an upstream side of the second communication portion 22*f* with respect to a developer conveyance direction in the second conveyance chamber 22*d* (an A2 direction indicated by arrow A2 in FIG. 3). Here, instead of the piezoelectric sensor, a magnetic permeability sensor, which detects magnetic permeability of the developer and outputs a voltage value corresponding to the detected magnetic permeability, may be used as the developer amount detecting sensor 50.

On a bottom of the first conveyance chamber 22*c*, a toner concentration detecting sensor 51 is disposed. The toner concentration detecting sensor 51 detects a ratio of toner to carrier (T/C) in the developer conveyed inside the developing container 22, and used as the toner concentration detecting sensor 51 is, for example, a magnetic permeability sensor which detects magnetic permeability of the developer inside the developing container 22. As illustrated in later-described FIG. 3, the toner concentration detecting sensor 51 is disposed in the first conveyance chamber 22*c*, at a position immediately adjacent to an upstream side of the first communication portion 22*e* with respect to a developer conveyance direction in the first conveyance chamber 22*e* (an A1 direction indicated by arrow A1 in FIG. 3).

Figure 3:
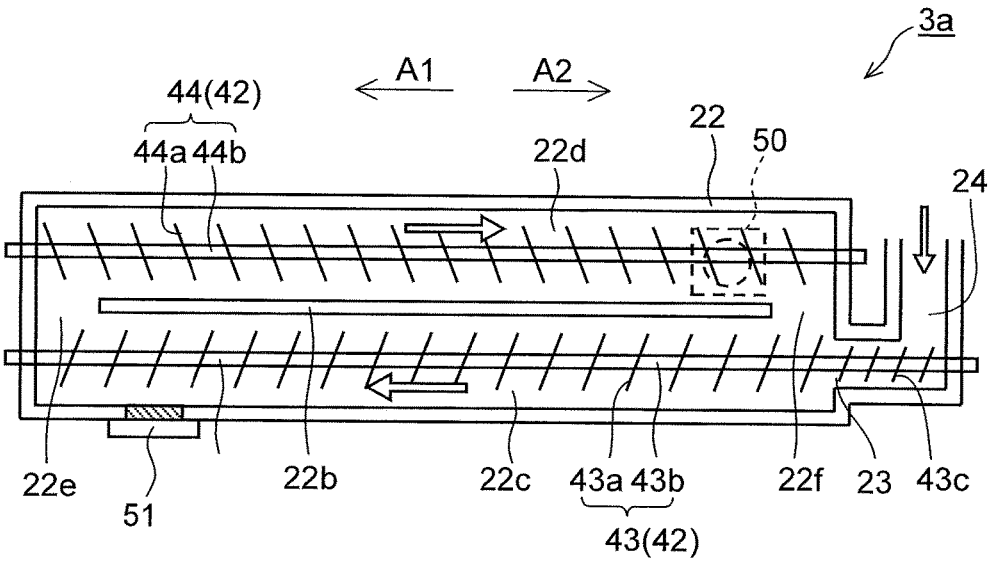
FIG. 3 is a vertical sectional view illustrating a structure of a stirring unit of the developing device.

FIG. 3 is a vertical sectional view (taken along line YY' of FIG. 2) illustrating a structure of a stirring unit of the developing device 3*a*. As illustrated in FIG. 3, the developing container 22 includes the partition 22*b*, the first conveyance chamber 22*c*, the second conveyance chamber 22*d*, the first communication portion 22*e*, and the second communication portion 22*f*.

The first communication portion 22*e* and the second communication portion 22*f* are respectively formed at one end and the other end (an A1-direction side end and an A2-direction side end) of the partition 22*b* in its longitudinal direction. The first communication portion 22*e* allows the first conveyance chamber 22*c* and the second conveyance chamber 22*d* to communicate with each other at their A1-direction (first-direction) end portions. The second communication portion 22*f* allows the first conveyance chamber 22*c* and the second conveyance chamber 22*d* to communicate with each other at their A2-direction (second-direction) end portions. Here, the second communication portion 22*f* is formed large enough to prevent the developer conveyed by the second spiral 44 from stagnating. And the developer circulates inside the developing container 22 by passing through the first conveyance chamber 22*c*, the first communication portion 22*e*, the second conveyance chamber 22*d*, and the second communication portion 22*f*.

The first spiral 43, which is disposed inside the first conveyance chamber 22*c*, has a rotary shaft 43*b* and a first spiral blade 43*a* disposed integrally with the rotary shaft 43*b* and formed in a spiral shape with a predetermined pitch in the axial direction of the rotary shaft 43*b*. The rotary shaft 43*b* is rotatably supported in the developing container 22. The first spiral blade 43*a* rotates in the counter-clockwise direction in FIG. 2, and thereby conveys the developer inside the first conveyance chamber 22*c* in the A1 direction (to one side in the axial direction of the developing roller 20), while stirring the developer.

Furthermore, in an end surface of the first conveyance chamber 22*c* in the A2-direction, there is provided a toner replenishing port 23 through which toner is replenished into the developing container 22. The toner replenishing port 23 has connected thereto a toner replenishing path 24, which leads to the toner container 4*a* (see FIG. 1). The rotary shaft 43*b* extends, passing through the toner replenishing port 23, into a toner replenishing path 24. The portion of the rotary shaft 43*b* that is disposed inside the toner replenishing path 24 has integrally formed thereon a replenishing blade 43*c*, which is formed in a shape of a spiral with a constant pitch along the axial direction of the rotary shaft 43*b*. The replenishing blade 43*c* is a spiral blade wound in the same direction (the same phase) as the first spiral blade 43*a*, and is formed with a smaller pitch and a smaller diameter as compared with the first spiral blade 43*a*.

The second spiral 44 disposed inside the second conveyance chamber 22*d* has a rotary shaft 44*b* and a second spiral blade 44*a* which is integrally formed with the rotary shaft 44*b* and which is formed in a shape of a spiral wound in the same direction (the same phase) as the first spiral blade 43*a*. The rotary shaft 44*b* is disposed parallel to the rotary shaft 43*b*, and rotatably supported in the developing container 22. The second spiral blade 44*a* rotates in a clockwise direction in FIG. 2, and thereby conveys the developer existing in the second conveyance chamber 22*d* in the A2 direction (a direction opposite to the A1 direction), while stirring the developer, to supply the developer to the developing roller 20 (see FIG. 2).

The developer in the first conveyance chamber 22*c* is conveyed in the A1 direction, while being stirred, by the first spiral 43, and gradually accumulates on one side (first communication portion-22*e* side) of the first conveyance chamber 22*c*. The developer already existing on the one side of the first conveyance chamber 22*c* is pushed by another portion of the developer newly coming to the one side, and is forced up into the second conveyance chamber 22*d* via the first communication portion 22*e*.

Then, the developer is conveyed in the A2 direction, while being stirred, by the second spiral 44, to be supplied to the developing roller 20. The developer remaining on the developing roller 20 without being used in development falls from the developing roller 20, and is collected by the second conveyance chamber 22*d*. Then, the collected developer is conveyed by the second spiral 44 to the other side (second communication portion-22*f* side) of the second conveyance chamber 22*d*, and falls into the first conveyance chamber 22*c* via the second communication portion 22*f*.

In the developing device 3*a*, the second conveyance chamber 22*d* is disposed above the first conveyance chamber 22*c*. That is, the first conveyance chamber 22*c* and the second conveyance chamber 22*d* are arranged one over the other. With this arrangement, it is possible to make the developing device 3*a* more compact in the horizontal direction, and thus it is possible to make the color printer 100 more compact. Here, in the color printer 100, which is a color image forming apparatus, four developing devices 3*a* to 3*d* are arranged in the horizontal direction, and thus, making the developing devices 3*a* to 3*d* compact is particularly effective.

Figure 4:
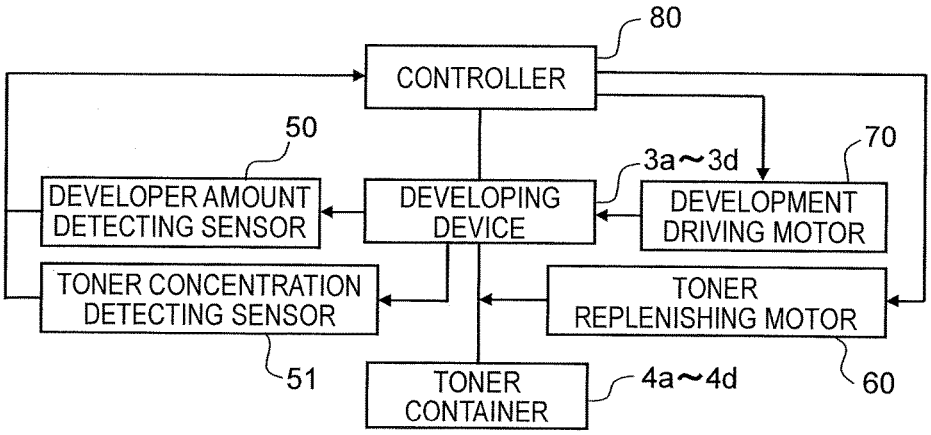
FIG. 4 is a block diagram illustrating a control route of the color printer of the first embodiment.

FIG. 4 is a block diagram showing an example of a control route used in the color printer 100 of the first embodiment. In use of the color printer 100, various controls of the portions thereof are performed, and thus the control route in the entire color printer 100 is complex. Here, for convenience of description, the following description will focus on portions of the control route that are necessary for the embodiment of the present disclosure.

A toner replenishing motor 60 replenishes the toner stored in each of the toner containers 4*a* to 4*d* to a corresponding one of the developing devices 3*a* to 3*d* at a predetermined speed. In the present embodiment, the magnetic permeability of the toner is detected by the toner concentration detecting sensor 51, and a voltage value corresponding to the detection result is fed to a controller 80, which will be described later, and the controller 80 determines the toner concentration inside each of the developing devices 3*a* to 3*d* based on the value fed from the toner concentration detecting sensor 51. The controller 80 transmits a control signal to the toner replenishing motor 60 in accordance with the thus determined toner concentration, and a predetermined amount of toner is replenished from each of the toner containers 4*a* to 4*d* via the toner replenishing port 23 (see FIG. 3) to a corresponding one of the developing devices 3*a* to 3*d*.

A development driving motor 70 is coupled via a gear train (not shown) to the first spiral 43 and the second spiral 44 disposed inside each of the developing devices 3*a* to 3*d*, and drives the first spiral 43 and the second spiral 44 to rotate at a predetermined speed based on a control signal from the controller 80. Note that, by coupling the development driving motor 70, via the gear train, also to the developing roller 20, the development driving motor 70 functions also as a driving source of the developing roller 20.

Figure 5:
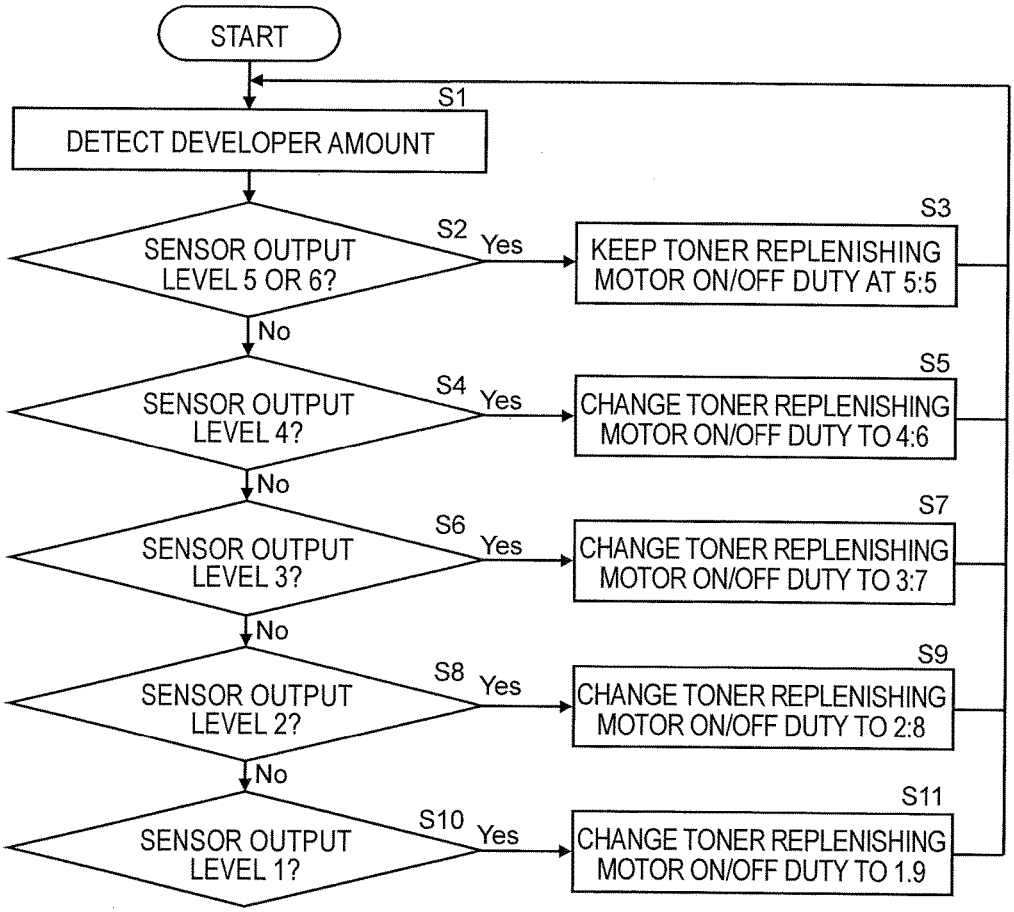
FIG. 5 is a flowchart illustrating an example of drive control of the color printer of the first embodiment.

FIG. 5 is a flowchart illustrating an example of drive control of the color printer 100 of the first embodiment. Referring to FIG. 1 to FIG. 4 as necessary, a description will be given of the procedure of replenishing the toner to each of the developing devices 3*a* to 3*d*, along the steps in FIG. 5.

When a printing instruction is fed from a host device such as a computer, a control signal is transmitted from the controller 80 to the development driving motor 70, and the first spiral 43 and the second spiral 44 inside each of the developing devices 3*a* to 3*d* start to be driven to rotate. The controller 80 detects an amount of developer based on a detection signal transmitted from the developer amount detecting sensor 50 (step S1). The developer amount detecting sensor 50 is disposed at a position immediately adjacent to the upstream side of the second communication portion 22*f*, and thus it detects an amount of developer that is conveyed from the second conveyance chamber 22*d*, passing through the second communication portion 22*f*, to fall into the first conveyance chamber 22*c*.

Next, the controller 80 changes a toner replenishing speed at which the toner is replenished to each of the developing devices 3*a* to 3*d*, in accordance with output level of the developer amount detecting sensor 50. Specifically, a table for correcting the toner replenishing speed, the table being used to determine the toner replenishing speed based on the output level of the developer amount detecting sensor 50, is stored in a storage (a ROM or a RAM) within the controller 80, and the toner replenishing speed is determined using the output level of the detection signal from the developer amount detecting sensor 50 and the table for correcting the toner replenishing speed. Table 1 shows an example of the table for correcting the toner replenishing speed.

TABLE 1

| | Developer Amount Detecting Sensor | Toner Replenishing Motor ON/OFF DUTY | |
|---|---|---|---|
| Level | Output Value M [V] | ON | OFF |
| Level_1 | 0.5 ≤ M < 1.0 | 1 | 9 |
| Level_2 | 1.0 ≤ M < 1.5 | 2 | 8 |
| Level_3 | 1.5 ≤ M < 2.0 | 3 | 7 |
| Level_4 | 2.0 ≤ M < 2.5 | 4 | 6 |
| Level_5 (Reference Value) | 2.5 ≤ M < 3.0 | 5 | 5 |
| Level_6 | 3.0 ≤ M | 5 | 5 |

In Table 1, output values of the developer amount detecting sensor 50 are ranked into Levels 1 to 6, and an ON-time/OFF-time DUTY (ratio) of the toner replenishing motor 60 corresponding to each of Levels 1 to 6 is stored. Here, output values that are 2.5 V or higher but lower than 3V are ranked in Level 5 (the reference value), and the ON/OFF DUTY of the toner replenishing motor 60 at that time is set to 5:5. And the DUTY is changed such that the ratio of the ON time of the toner replenishing motor 60 decreases (that is, the toner replenishing speed becomes lower) with the output level of the developer amount detecting sensor 50.

Back to FIG. 5, the controller 80 makes a judgment on whether or not the output level of the developer amount detecting sensor 50 is Level 5 (the reference value) or Level 6 (step S2). When the output level is Level 5 or Level 6 (Yes at step S2), the controller 80 keeps the ON time/OFF time DUTY of the toner replenishing motor 60 at 5:5 (step S3), and the flow returns to step S1, and the detection of the amount of developer is continued.

When the output level is not Level 5 or Level 6 (No at step S2), then, a judgment is made on whether or not the output level is Level 4 (step S4). When the output level is Level 4 (Yes at step S4), the controller 80 changes the ON-time/OFF-time DUTY of the toner replenishing motor 60 to 4:6 (step S5). Then, the flow returns to step S1, and the detection of the amount of developer is continued.

Likewise, the controller 80 makes judgments on whether or not the output level of the developer amount detecting sensor 50 is Level 3, Level 2, and Level 1 (steps S6, S8, and S10). Then, when the output level is Level 3, the controller 80 changes the ON-time/OFF-time DUTY of the toner replenishing motor 60 to 3:7 (step S7), when the output level is Level 2, the controller 80 changes the ON-time/OFF-time DUTY of the toner replenishing motor 60 to 2:8 (step S9), and when the output level is Level 1, the controller 80 changes the ON-time/OFF-time DUTY of the toner replenishing motor 60 to 1:9 (step S11). Thereafter, in whichever case, the flow returns to step S1, and the detection of the amount of developer is continued.

According to the control described above, when the amount of developer that is conveyed from the second conveyance chamber 22*d* to fall to the vicinity of the toner replenishing port 23 in the first conveyance chamber 22*c* is small, it is possible to lower the toner replenishing speed at which the toner is replenished from each of the toner containers 4*a* to 4*d* to a corresponding one of the developing devices 3*a* to 3*d*. As a result, even when the amount of developer that joins replenished toner is small, the ratio of the replenished toner with respect to the developer (the concentration of the replenished toner in the developer) is kept constant. Accordingly, it is possible to effectively reduce occurrence of problems which are caused by locally high concentration of the replenished toner, such as fogging of images and uneven image density.

Note that the amount of toner to be replenished to each of the developing devices 3*a* to 3*d* is determined based on the detection signal from the toner concentration detecting sensor 51, and thus has no relation to the output level of the developer amount detecting sensor 50. For example, in a case where the output level of the developer amount detecting sensor 50 is low (the ON time ratio of the toner replenishing motor 60 is small) and the amount of toner to be replenished determined based on the detection signal from the toner concentration detecting sensor 51 is large, a predetermined amount of toner is replenished to each of the developing devices 3*a* to 3*d* by prolonging the driving time of the toner replenishing motor 60.

Figure 6:
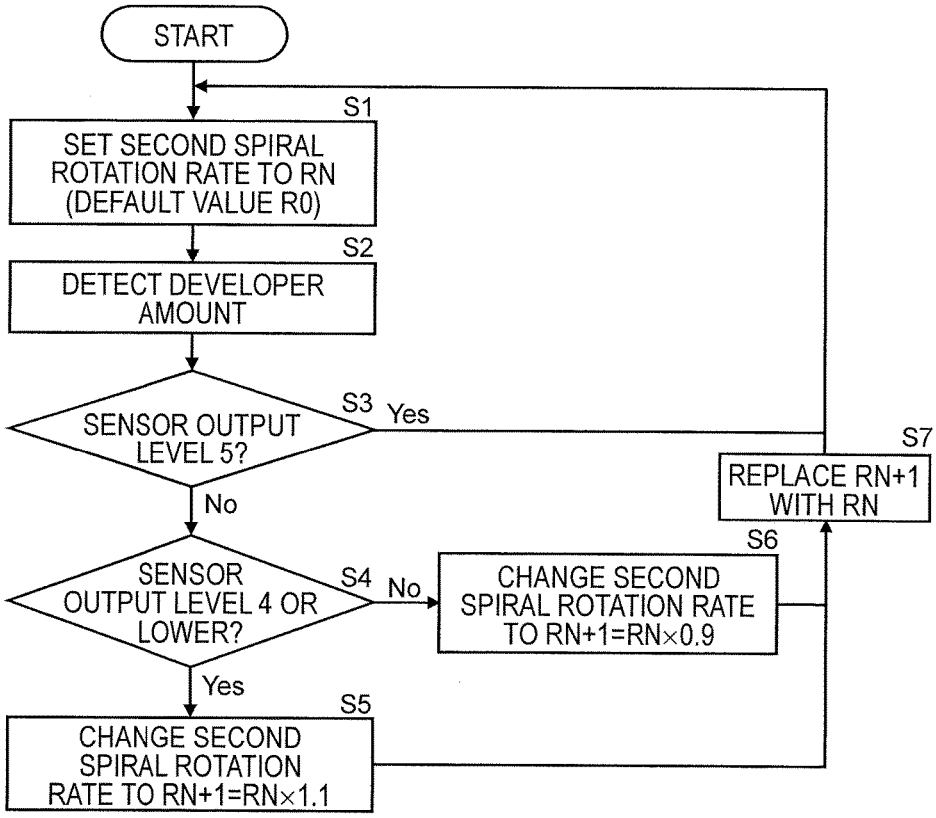
FIG. 6 is a flowchart illustrating an example of drive control of a color printer of a second embodiment of the present disclosure.

FIG. 6 is a flowchart illustrating an example of drive control of the a color printer 100 according to a second embodiment of the present disclosure. The structure of the developing devices 3*a* to 3*d* and the control route in the color printer 100 of the second embodiment are similar to those in the first embodiment, but in the second embodiment, in the developing devices 3*a* to 3*d*, it is possible to change the rotation rate (the number of rotations per unit time) of the first spiral 43 and that of the second spiral 44 independently of each other by means of the development driving motor 70. Referring to FIG. 1 to FIG. 4 as necessary, a description will be given of the procedure of controlling the developing device 3*a*, along the steps in FIG. 6.

A control signal is transmitted from the controller 80 to the development driving motor 70, and the first spiral 43 and the second spiral 44 in each of the developing devices 3*a* to 3*d* start to be driven to rotate. The controller 80 starts the rotation of the second spiral 44 with Rn (the default value of which is R0) as the number of rotations of the second spiral 44 per unit time (step S1). Further, the controller 80 detects the amount of developer based on a detection signal transmitted from the developer amount detecting sensor 50 (step S2).

Next, the controller 80 changes the number of rotations of the second spiral 44 per unit time (hereinafter, the number of rotations per unit time will be referred to simply as rotation rate) based on the output level (Levels 1 to 6 in Table 1) of the developer amount detecting sensor 50. Specifically, first, a judgement is made on whether or not the output level of the developer amount detecting sensor 50 is Level 5 (the reference value) (step S3). When the output level is Level 5 (Yes at step S3), the rotation rate of the second spiral 44 is kept at R0, and the flow returns to step S1.

When the output level is not Level 5 (No at step S3), then a judgment is made on whether or not the output level is Level 4 or lower (step S4). When the output level is Level 4 or lower (Yes at step S4), the controller 80 changes the rotation rate of the second spiral 44 to Rn+1=Rn×1.1 (step S5).

When the output level is not Level 4 or lower (No at step S4), the output level is Level 6, and thus the controller 80 changes the rotation rate of the second spiral 44 to Rn+1=Rn×0.9 (step S6). Thereafter, Rn+1 is replaced with Rn (step S7), and then the flow returns to step S1, and the detection of the amount of developer and changing of the rotation rate of the second spiral 44 are repeated until the output level becomes Level 5.

According to the control described above, when the amount of developer that is conveyed from the second conveyance chamber 22*d* to fall to the vicinity of the toner replenishing port 23 in the first conveyance chamber 22*c* is small, the rotation rate (rotation speed) of the second spiral 44 is increased to thereby increase the amount of developer that is conveyed from the second conveyance chamber 22*d*, passing through the second communication portion 22*f*, into the first conveyance chamber 22*c*. On the other hand, when the amount of developer that is conveyed from the second conveyance chamber 22*d* to fall to the vicinity of the toner replenishing port 23 in the first conveyance chamber 22*c* is large, the rotation rate (rotation speed) of the second spiral 44 is reduced to thereby reduce the amount of developer that is conveyed from the second conveyance chamber 22*d*, passing through the second communication portion 22*f*, into the first conveyance chamber 22*c*.

Thereby, the amount of developer that is conveyed from the second conveyance chamber 22*d*, passing through the second communication portion 22*f*, to fall to the vicinity of the toner replenishing port 23 in the first conveyance chamber 22*c* is stabilized, and thus, as in the first embodiment, the ratio of the replenished toner with respect to the developer (the concentration of the replenished toner in the developer/per unit volume of the developer) is kept constant. Accordingly, it is possible to effectively reduce occurrence of problems which are caused by locally high concentration of the replenished toner, such as fogging of images and uneven image density. Moreover, the circulation balance of the developer inside the developing container 22 also is adjusted, and this contributes to stable supply of the developer from the second conveyance chamber 22*d* to the developing roller 20.

The embodiments described above are in no way meant to limit the present disclosure, which thus allows for many modifications and variations within the spirit of the present disclosure. For example, the above embodiments have dealt with examples where the developer is supplied to a developing roller from a stirring-conveyance member, but they are by no means meant to limit the scope of the present disclosure. A developer carrier such as a magnetic roller or a like may further be disposed between the stirring-conveyance member and the developing roller, such that developer is supplied from the stirring-conveyance member to the magnetic roller or the like and then the developer is supplied from the magnetic roller or the like to the developing roller. Furthermore, the above embodiments have dealt with examples of the developing devices 3*a* to 3*d* in each of which the second conveyance chamber 22*d* is disposed vertically above the first conveyance chamber 22*c*, but the second conveyance chamber 22*d* and the first conveyance chamber 22*c* may be displaced from each other in the horizontal direction.

Figure 7:
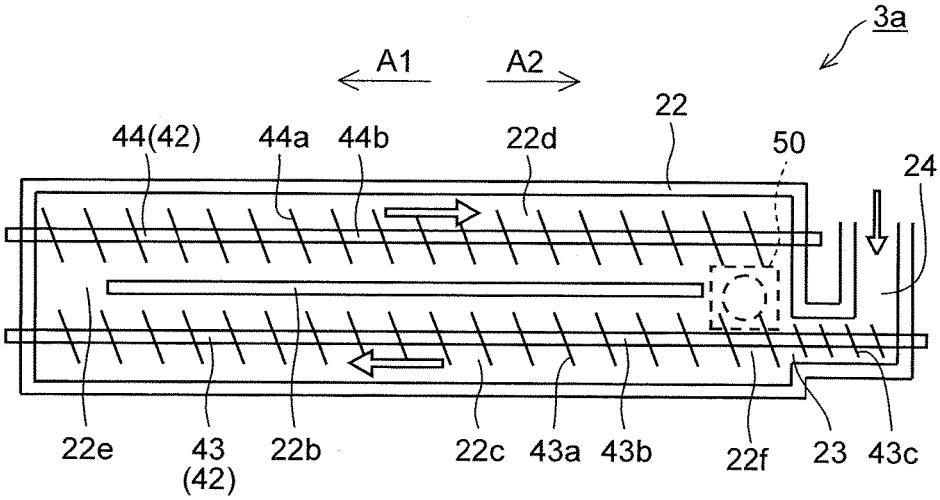
FIG. 7 is a side sectional view illustrating a structure of a developing device in which a developer amount detecting sensor is disposed in a second communication portion.

Further, the above embodiments have dealt with examples where a developer amount detecting sensor 50 is disposed in a second conveyance chamber 22*d*, at a position immediately adjacent to an upstream side of a second communication portion 22*f* with respect to a developer conveyance direction (the A2 direction), but instead, for example, as illustrated in FIG. 7, the developer amount detecting sensor 50 may be disposed on a side surface of a second communication portion 22*f*.

Further, the present disclosure is applicable not only to the tandem type color printer 100 illustrated in FIG. 1, but also to various image forming apparatuses including both digital and analog types of monochrome copiers, color copiers, facsimile machines, and so on which each incorporate a developing device including a first conveyance chamber and a second conveyance chamber disposed above the first conveyance chamber.

The present disclosure is applicable to a developing device having a first conveyance chamber and a second conveyance chamber disposed above the first conveyance chamber. Use of the present disclosure makes it possible to provide a developing device which prevents occurrence of a portion with locally high concentration of replenished toner, even when the circulation balance of developer is changed, and thus is capable of reducing occurrence of problems such as fogging of images and uneven image density, and an image forming apparatus incorporating such a developing device.

What is claimed is:

1. An image forming apparatus comprising:

a developing device including a developing container which includes a first conveyance chamber, a second conveyance chamber disposed above the first conveyance chamber, a first communication portion which allows the first conveyance chamber and the second conveyance chamber to communicate with each other at end portions thereof on a downstream side in a first direction, a second communication portion which allows the first conveyance chamber and the second conveyance chamber to communicate with each other at end portions thereof on a downstream side in a second direction, the second direction being a direction opposite to the first direction, and a toner replenishing port which is disposed at an end portion of the first conveyance chamber on the downstream side in the second direction for toner replenishment to the developing container, the developing container holding therein a two-component developer including a carrier and a toner, a first stirring-conveyance member which is rotatably supported inside the first conveyance chamber, and conveys the developer in the first conveyance chamber in the first direction, while stirring the developer, a second stirring-conveyance member which is rotatably supported in the second conveyance chamber, and conveys the developer in the second conveyance chamber in the second direction, while stirring the developer, and a developer carrier which is rotatably supported in the developing container, and carries on a surface thereof the developer in the second conveyance chamber;

a toner reservoir which holds therein the toner to be replenished to the developing device;

a toner replenishing device which replenishes the toner from the toner reservoir to the developing device;

a development driving device which drives the first stirring-conveyance member and the second stirring-conveyance member;

a controller which controls driving of the toner replenishing device and driving of the development driving device; and a developer amount detecting sensor which detects an amount of developer conveyed from the second conveyance chamber, through the second communication portion, to fall to vicinity of the toner replenishing port in the first conveyance chamber, wherein the controller controls the driving of the toner replenishing device or the driving of the development driving device based on a result of detection performed by the developer amount detecting sensor, and thereby keeps a ratio of the replenished toner replenished through the toner replenishing port with respect to the developer conveyed from the second conveyance chamber, through the second communication portion, to fall to vicinity of the toner replenishing port in the first conveyance chamber, and the development driving device is capable of changing a rotation speed of the first stirring-conveyance member and a rotation speed of the second stirring-conveyance member independently of each other, and the controller increases the rotation speed of the second stirring-conveyance member, which is driven by the development driving device, according as the amount of developer detected by the developer amount detecting sensor becomes increasingly smaller than a reference value.

2. The image forming apparatus according to claim 1, wherein in a case where the amount of developer detected by the developer amount detecting sensor is larger than the reference value, the controller reduces the rotation speed of the second stirring-conveyance member, which is driven by the development driving device.

3. The image forming apparatus according to claim 2, wherein the controller repeats detection of the amount of developer using the developer amount detecting sensor and changing of the rotation speed of the second stirring-conveyance member until the amount of developer detected by the developer amount detecting sensor reaches the reference value.

4. The image forming apparatus according to claim 1, wherein the developer amount detecting sensor is disposed on a side surface of the second conveyance chamber, at a position immediately adjacent to an upstream side of the second communication portion with respect to the second direction, or on a side surface of the second communication portion.

* * * * *